United States Patent [19]

Schwär

[11] Patent Number: 5,040,338

[45] Date of Patent: Aug. 20, 1991

[54] APPARATUS FOR THE GRINDING OF BRAKE DISKS

[75] Inventor: Rudolf Schwär, Wuppertal, Fed. Rep. of Germany

[73] Assignee: Ernst Thielenhaus KG, Wuppertal, Fed. Rep. of Germany

[21] Appl. No.: 505,941

[22] Filed: Apr. 6, 1990

[30] Foreign Application Priority Data

Apr. 11, 1989 [DE] Fed. Rep. of Germany ..... 3911719

[51] Int. Cl.[5] ..... B24B 5/00; B24B 7/17; B24B 49/00

[52] U.S. Cl. ..... 51/118; 51/132; 51/165.75; 51/DIG. 3; 51/281 SF; 51/215 UE

[58] Field of Search ..... 51/DIG. 3, 51, 104, 51/106 R, 132, 165.71, 165.75, 118, 111, 112, 113, 114, 117, 28 SF, 165.77, 165.9, 165.91, 165.87, 165.88, 215 UE, 131.3, 165.76

[56] References Cited

U.S. PATENT DOCUMENTS 3,823,627 7/1974 Scharfen ..... 51/118 X
4,361,988 12/1982 Gramlich ..... 51/118
4,434,582 3/1984 Strauss et al. ..... 51/215 UE X
4,753,045 6/1988 Fetouh et al. ..... 51/112

FOREIGN PATENT DOCUMENTS 297071 12/1986 Japan ..... 51/106 R

*Primary Examiner*—Frederick R. Schmidt
*Assistant Examiner*—Bruce P. Watson
*Attorney, Agent, or Firm*—Herbert Dubno

[57] ABSTRACT

An apparatus for the fine grinding of rotating brake disks in the context of a flexible machining line. The grinding machine has a portal which forms a slide shiftable on a machine frame relative to a brake-disk holder having a fixed axis to allow adjustment for different diameters of hubs of lots of the brake disks which are ground on the machine. The brake disks are fed with vertical axes in succession to a fixed pickup location, are gripped by a manipulator and transferred to the holder where they are rotated about the horizontal axis of the latter to be ground by grinding wheels carried by the portal.

1 Claim, 3 Drawing Sheets

APPARATUS FOR THE GRINDING OF BRAKE DISKS

FIELD OF THE INVENTION

My present invention relates to an apparatus for the grinding, especially the fine grinding or finish grinding of brake disks.

BACKGROUND OF THE INVENTION

In the manufacture of brake disks, especially for disk-brake systems in which the brake disk passes between a pair of brake shoes carried by a caliper extending around the outer periphery of the disk, the brake disk generally has a crown portion or outer peripheral strip which constitutes the engagement portion and is formed with opposite surfaces engaged by the respective brake shoes, and a cup-shaped hub portion located inwardly of a crown portion.

The crown portion generally lies in a plane from which the hub portion or disk cup projects to one side.

After formation of the basic disk body, e.g. by forging and/or casting, it is a common practice to finish the braking surfaces of the crown of the disks, generally by a grinding process. This grinding may be a finishing grinding following, for example, a turning or facing operation. Reference to "grinding" herein, as far as the invention is concerned, will be understood to include fine grinding or finish grinding of the surfaces.

In the past, for the grinding of such brake disks, the apparatus which was provided generally could accommodate only a single size of disk. However, since disks are fabricated in lots of different sizes, it is advantageous to be able to grind the disks of different sizes in the different lots in one and the same apparatus.

It has been the practice heretofore to provide disk-grinding machines for this purpose which comprise a feed conveyor, generally a roller conveyor, upon which a succession of brake-disk workpieces are supplied in a predetermined cadence, a discharge conveyor, generally a roller conveyor, on which the ground workpieces are carried off, a grinding machine with grinding tools disposed on opposite sides of a disk introduced into the machine to grind the opposite surfaces thereof as the disk is rotated, and a manipulator or the like for picking up the brake-disk workpiece, carrying it to the grinding machine, removing the ground disk from the machine and placing the ground disks on the discharge-roller conveyor.

While such an apparatus has been found to be highly suitable for the mass or serial production of brake disks, problems have been encountered heretofore with respect to the limited versatility of the apparatus and especially its inability to adjust to various sizes, e.g. diameters of the brake disks.

In general, the apparatus had a so-called machine portal or stand carrying the grinding tools and the respective motors, which was fixedly mounted in the machine frame provided with the holder for the workpiece during the grinding operation. To accommodate the machine to process disks of other sizes, i.e. other lots of brake disks, it was necessary to disassemble and reassemble the apparatus to accommodate the different relative positions of the grinding tools and the holders.

The feed and discharge devices also required adjustment and, as a consequence, the down time of the apparatus was considerable. Clearly this drawback was inconsistent with the high speed operations of the machine and otherwise rendered the apparatus unacceptable for uses in which a number of lot changes might occur with time based upon changes in the diameter or size of the disk.

OBJECTS OF THE INVENTION

It is, therefore, the principal object of the present invention to provide an improved grinding apparatus for the purposes described which is free from the drawbacks outlined above.

Another object of the invention is to provide a grinding machine for brake disks which has high versatility and can be adjusted in short order to different diameters of the brake disk and brake-disk cup or hub in a simple manner with a minimum of interruption in the productivity of the apparatus.

Still another object of the invention is to provide an improved grinding apparatus for the purposes described which has a high output and can be easily adjusted for the grinding of lots of brake disks of different sizes.

SUMMARY OF THE INVENTION

These objects and others which will become apparent hereinafter are attained, in accordance with the invention, utilizing feed and discharge devices, i.e. conveyors, cooperating with a transfer tool or manipulator, which picks up the brake disk at a fixed pickup position and transfers the workpiece to a workpiece holder at a fixed location in the machine frame.

According to a feature of the invention, the machine portal is displaceable adjustably in the machine frame in accordance with the different diameters of the cup-shaped brake disk hub of the brake disk to be ground.

The invention is based upon the fact that the entire machine portal can become the adjustable member of the machine which allows significant simplification of the workpiece holder and also simplification of the mounting of the tools and the respective drives while achieving the desired adjustability.

Only the machine portal is required to be horizontally displaceable by an amount equivalent to the variation in the diameter of the cup-shaped disk hub upon a lot change. Neither the workpiece holder nor the feed and discharge conveyors need be adjusted as a result.

It has been found to be advantageous to adjust the position of the machine portal in the machine frame with a high degree of precision by providing the machine portal as a slide which is guided in a frame and has, at its base, guide means cooperating with guide means of the frame. Such guide means can be rails formed by the machine frame and lateral guide rollers engageable with the slide. The slide can thus be displaced along the rails and in lateral engagement with the rollers with a minimum of lateral play. Advantageously, the slide can be held in place in its guide by a clamping device.

The described linear guidance of the machine portal can be achieved utilizing devices of modern control technology with extremely high precision and a minimum of play.

For example, the slide can be shiftable adjustably by a positioning motor, especially a servomotor and can be held by an automatically actuated clamping device.

The apparatus of the invention can thus be integrated into an automatic flexible machining line in which the motor and the clamping device can be controlled by a computer or the like.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
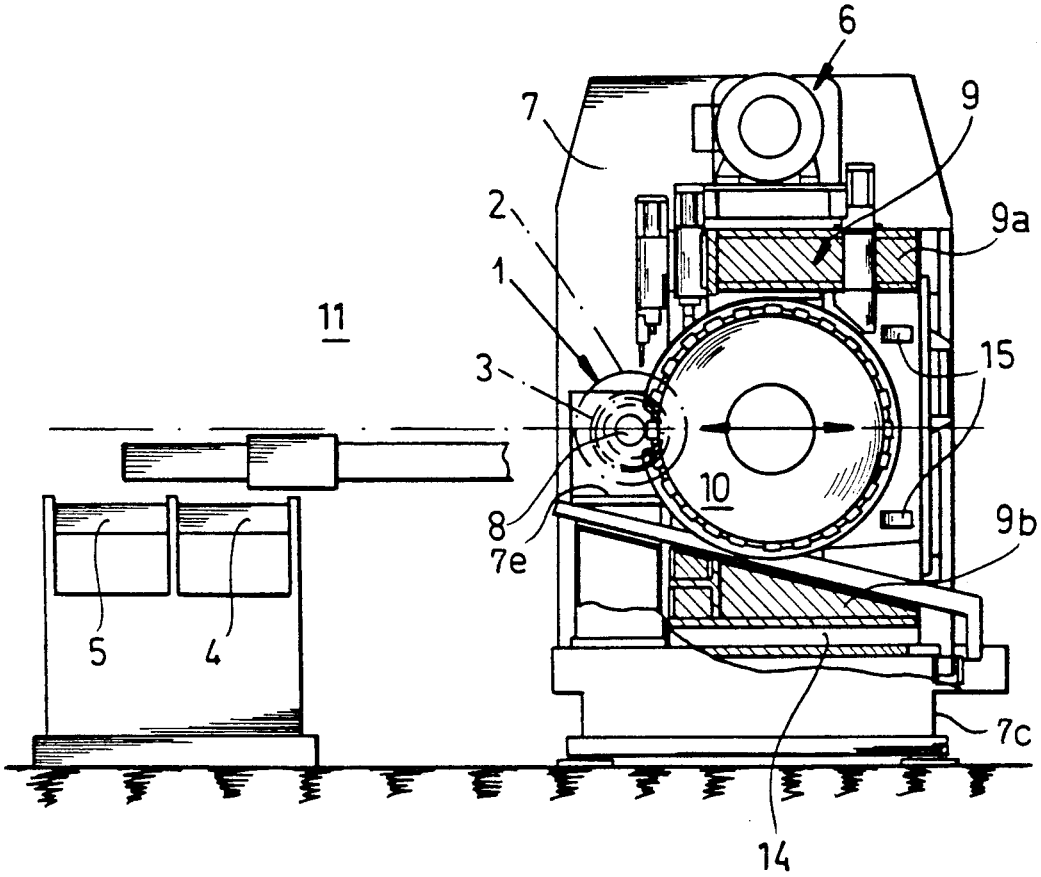
FIG. 1 is a side elevational view of the apparatus of the invention in highly diagrammatic form.
Figure 2:
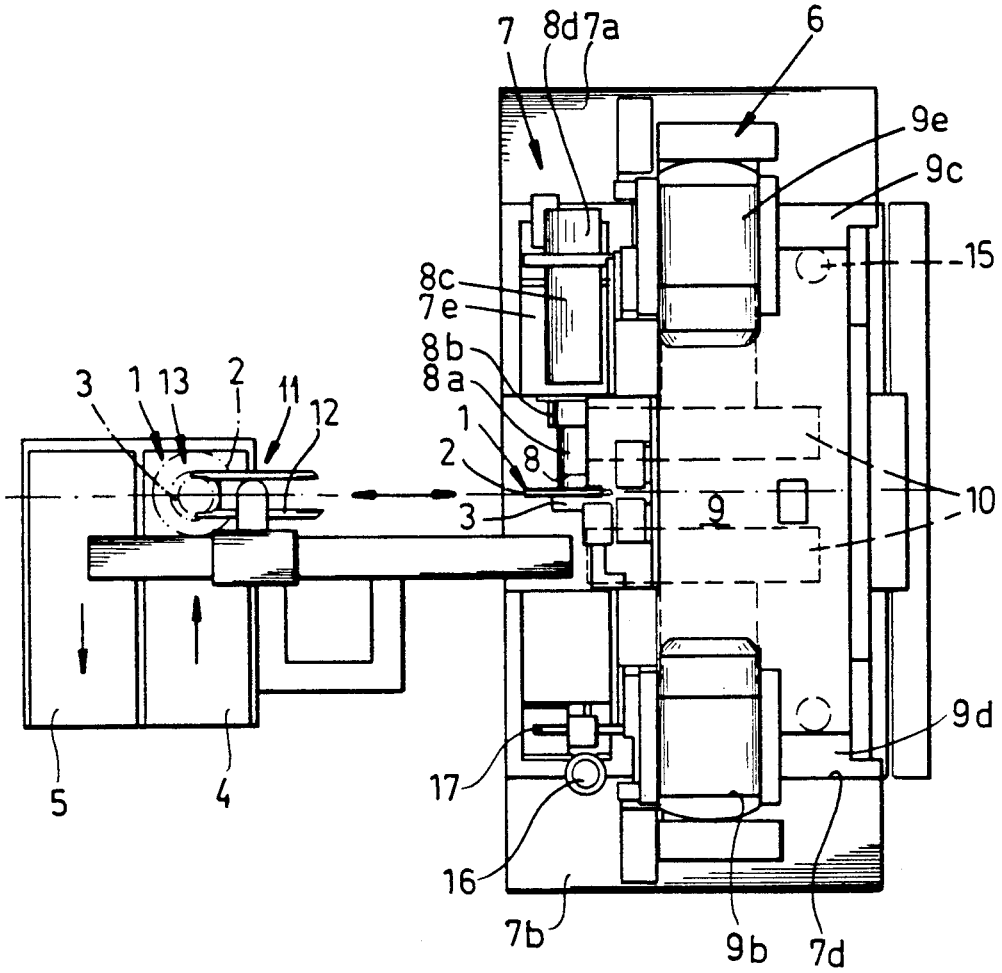
FIG. 2 is a plan view of the apparatus.

In FIGS. 1 and 2 I have shown a machine for the grinding and especially the fine grinding of the annular braking surfaces of a brake disk 1 having a crown 2 which is to be ground, and a brake disk cup or hub 3. This apparatus can be provided in a flexible machining line and is intended for the machining of brake disks of various sizes which are successively delivered in respective lots to the machining line. Generally the different sizes of brake disks are represented by different diameters of the brake-disk hub or cup 3.

The apparatus comprises a feed conveyor 4 in the form of a roller conveyor, which delivers the individual brake disks 1 at a predetermined cadence for the succession rate.

A discharge-roller conveyor 5 can be disposed adjacent the roller conveyor 1 for carrying away the brake disks which have been ground. To one side of the conveyors is a grinding machine generally represented at 6.

The grinding machine 6 comprises a machine frame 7. The machine frame 7 can be seen in FIGS. 1 and 2 to comprise a pair of uprights 7*a* and 7*b* connected by a base 7*c* and defining between these uprights an opening generally represented at 7*d*.

At one side of the opening and mounting on the upright 7*a* is a holder 8 adapted to engage in a cup 3 and a brake disk 1 which is positioned so that its horizontal axis is aligned with the horizontal axis of the holder. As is also apparent from FIG. 2, the holder 8 is formed on a spindle 8*a* journaled for rotation about a fixed horizontal axis in a bearing arrangement 8*b* on a bracket 7*e* of the machine frame. The bracket 7*e* may also carry a motor 8*c* driving the spindle through a transmission 8*d*. The holder, spindle and drive mechanism therefore have not been illustrated in detail since any drive arrangement and any arrangement whereby the holder can engage in, retain and rotate the brake disk 1 about a horizontal axis fixed with respect to the machine frame, can be used.

In addition, the machine frame comprises a portal or stand, i.e. the machine portal 8 which, in turn, has horizontal limbs 9*a* and 9*b* shown in cross section in FIG. 1 and vertical limbs 9*c* and 9*d* better seen in FIG. 2. These limbs carry motors 9*e* and 9*f* driving grinding wheels 10 which are rotatable about a horizontal axis parallel to the axis of holder 8 and which can be displaced toward and away from one another by means not shown so that they can engage the surfaces of the brake disk to be ground.

The apparatus also comprises a feeding and removing device 11 in the form of a manipulator, which operates to pick up a brake disk 1 arriving on the feed roller conveyor 4, position it on the holder 8, remove a machine workpiece from the holder 8 and convey it to the roller conveyor 5 and repeat the process.

The brake disks 1 are transported by the feed-roller conveyor 4 so that their axes are vertical. In the grinding machine 6, however, the brake disks are rotated about the horizontal axis of the holder 8. For that purpose, the manipulator 11 may comprise an arm 11*a* which may telescope and be swingable about an axis 11*b* and can carry, in turn, via a horizontal pivot 11*c*, a gripper 11*d*. As can be seen in FIG. 4, this gripper can have two bars 11*e* which can be moved toward and away form one another by hydraulic piston-and-cylinder devices 11*f*. Thus, once the gripper engages the hub of a brake disk in the gripper position shown in FIG. 3, a servomotor 11*g* can operate to swing that brake disk into an upright position with its axis horizontal, as can be seen from FIG. 4.

The manipulator is formed on a carriage 11*h* which is displaceable on a rail 11*j* by a motor (not shown) under the control of a computer 20 as represented by the dot-dash line 21. Once the brake disk is in the position shown in FIG. 4, therefore, the carriage can carry the brake disk into the grinding machine to align its axis with the axis of holder 8 and permit the holder to engage the brake disk. Conversely, the gripper can engage a brake disk on the holder and transport it away and lay it down upon the conveyor 5 upon retraction of the holder 8 from the brake disk.

Figure 3:
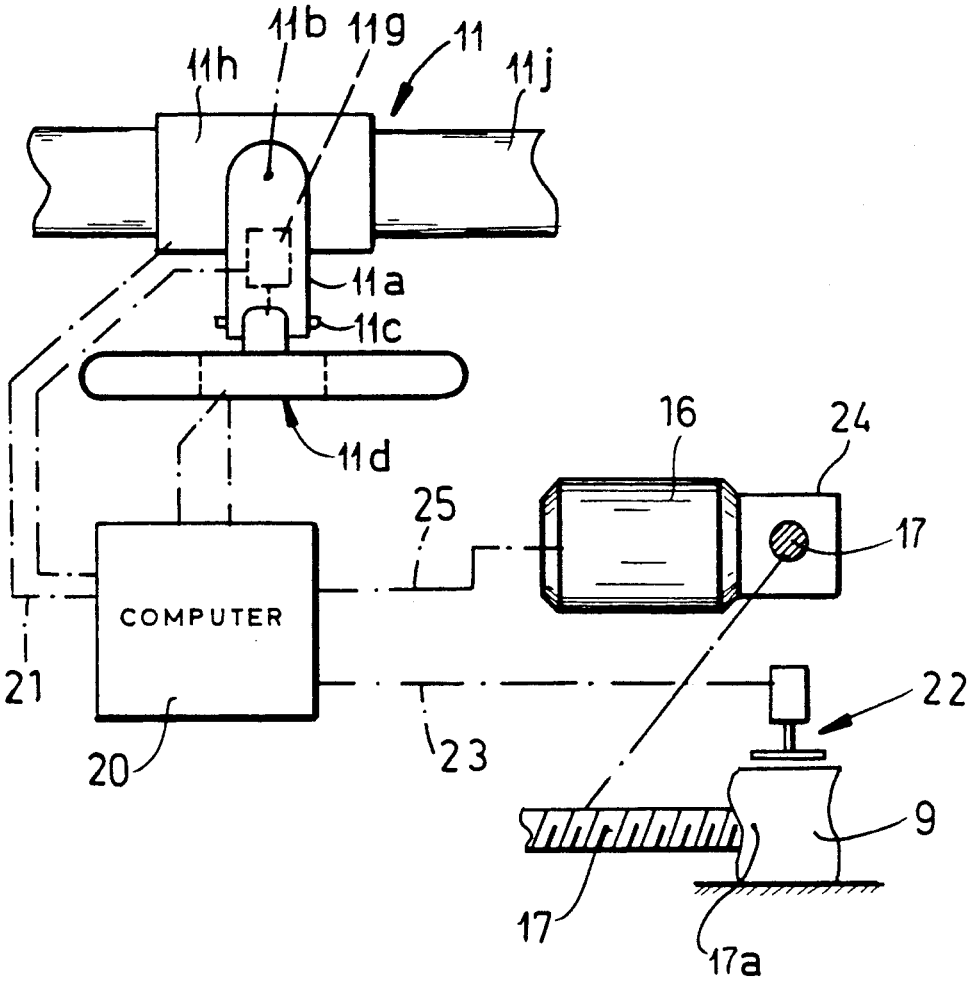
FIG. 3 is a view of the manipulator of FIGS. 1 and 2 as seen from the opposite side and diagrammatically illustrating the connection between the computer and computer control parts of the apparatus.
Figure 4:
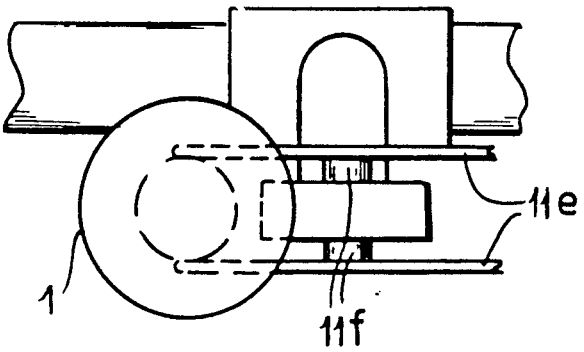
FIG. 4 shows the manipulator as seen in FIG. 3 with the brake disk rotated into a vertical position for mounting on the workpiece holder of the machine frame of FIGS. 1 and 2.

FIGS. 1–3 also make clear that the machine portal 9, as a unit, forms a slide which can ride on guide rails 14 formed on the base 7*c* of the machine frame. Furthermore, rollers 15 are provided on the base of the machine frame to laterally guide the portal 9. In addition, as can be seen from FIG. 3, a clamping device 22 can engage the portal 9 to lock it in place in a position to which it is displaced. The clamping device may include a hydraulic cylinder and piston arrangement controlled by the computer 20 as represented by the dot-dash line 23.

The machine portal 9 is displaced along this linear guide by a servomotor 16 which drives a threaded spindle 17 engaging a nut formation 17*a* of the portal 9. A speed-reducing transmission 24 can be provided between the motor 16 and the spindle 17. The motor 16, for high-precision adjustment, may be a pulse motor controlled by the computer 20 as represented by the line 25. The computer 20 may be the master computer operating the machining line as a whole.

In operation, therefore, the computer 20 commands, as each brake disk arrives at conveyor 4 with its axis in a vertical orientation, the engagement of a previously ground disk at the holder 8 and its transfer to the conveyor 5, the subsequent pickup of the disk 1 on the conveyor 4 and rotation of that disk into a vertical position with its axis horizontal, transfer of the disk 1 to the holder 8, automatic adjustment of the position of the portal to accommodate the size of the cup or hub portion 3 of the disk, advance of the grinding wheels to engage the opposite surfaces of the crown 2, rotation of the disk by the motor 8*c* to ensure uniform grinding and driving of the grinding wheels. When the computer determines that finish grinding is completed, the sequence is repeated.

I claim:

1. An apparatus for grinding brake disks having a disk crown and a disk hub, comprising:

a feed conveyor advancing brake disks in succession to a pickup location with said disks having vertical axes;

a grinding machine spaced from said location and including:

a machine frame, a brake disk holder on said frame having a horizontal axis at a fixed distance from said location, a machine portal on said frame provided with grinding tools for grinding a crown of a brake disk engaged by said holder, and linear guide means between said portal and said frame linearly guiding said portal for displacement relative to said holder in a direction perpendicular to said axis of said holder to adjust said machine to lots of brake disks of different sizes;

a manipulator shiftable between said conveyor and said machine and provided with means for picking up a brake disk at said location from said feed conveyor and mounting said brake disk on said holder;

a discharge conveyor positioned to receive ground brake disks from said manipulator upon removal of said ground brake disks from said holder;

means including a positioning motor for displacing said portal on said frame along said guide means in accordance with a diameter of a hub of a brake disk to be ground, said portal being formed as a slide and said guide means including guide rails formed in a base of said machine frame and lateral rollers engaging said portal;

an automatically actuatable clamping device engageable with said portal for locking same in place with respect to said frame; and computer control means connected to said motor and to said clamping device for operating same.

* * * * *